US005354724A

United States Patent [19]

Hoffmann et al.

[11] Patent Number: 5,354,724

[45] Date of Patent: Oct. 11, 1994

[54] HEAT SENSITIVE RECORDING MATERIALS WITH POLYMER ENROBED SENSITIZER

[75] Inventors: Dietrich Hoffmann, Roedersheim-Gronau; Bernhard Schuler, Mannheim, both of Fed. Rep. of Germany

[73] Assignee: BASF Aktiengesellschaft, Ludwigshafen, Fed. Rep. of Germany

[21] Appl. No.: 99,008

[22] Filed: Jul. 29, 1993

[30] Foreign Application Priority Data

Aug. 5, 1992 [DE] Fed. Rep. of Germany ..... 4225863

[51] Int. Cl.[5] ..... B41M 5/26

[52] U.S. Cl. ..... 503/209; 503/215

[58] Field of Search ..... 503/209, 215, 208

[56] References Cited

U.S. PATENT DOCUMENTS

| | | | |
|---|---|---|---|
| 4,406,816 | 9/1983 | Sliwka | 521/69 |
| 4,520,376 | 5/1985 | Morishita et al. | 346/204 |
| 4,749,679 | 6/1988 | Yoshida et al. | 503/208 |

FOREIGN PATENT DOCUMENTS 3512565 10/1986 Fed. Rep. of Germany .

*Primary Examiner*—Pamela R. Schwartz

*Attorney, Agent, or Firm*—Oblon, Spivak, McClelland, Maier & Neustadt

[57] ABSTRACT

Recording materials which contain one or more optionally polymer-enrobed dye precursors, one or more optionally polymer-enrobed developers and one or more polymer-enrobed sensitizers are described.

6 Claims, No Drawings

HEAT SENSITIVE RECORDING MATERIALS WITH POLYMER ENROBED SENSITIZER

The present invention relates to heat sensitive recording materials comprising one or more optionally polymer enrobed dye precursors, one or more optionally polymer enrobed dye developers and one or more polymer enrobed sensitizers.

Heat sensitive recording materials, also known as thermal papers, are widely used for printing and copying. They require fast reacting systems notable not only for a bright, high contrast appearance of the script but also for the long life of the image obtained. No graying of the ready-produced paper must take place. Compared with other recording techniques the advantages include the elimination of a development process, the price, the quietness of the reproduction equipment, and the intensity of the print.

The thermally reactive components present in thermal papers are a colorless or substantially colorless dye precursor and a developer, and are both solid at room temperature. Suitable dye precursors include not only leuco dyes, which can be converted into the colored form by oxidation, but also diazo components as precursors of azo dyes. In the first case, the developer will be an electron acceptor, while in the second case it will be a coupling component and, if necessary, a basic substance to speed up the coupling reaction. Thermal papers are produced by applying the dye precursor and the developer to a base paper in a single- or multi-stage coating process together with binders and, if desired, pigments. Color development is effected by briefly heating the paper locally with a thermal printing head (thermal pulse). The reactive components melt to some extent and react to form the dye and hence the color. To reduce the necessary temperature and/or duration of the thermal pulse and hence to increase the printing speed, it is customary to add a sensitizer which itself is likewise solid at room temperature but lowers the melting points of the color-forming components. The prerequisite for the use of a sensitizer is that it should not lead to premature development either in the production or in the storage of the paper coating compositions.

US-A-4 520 376 describes the enrobing of dye precursor, developer and waxy sensitizer with a thermally stable microcapsule within which color development takes place on heating. First the dye precursor and the developer are each melted together with the sensitizer, emulsified, and encapsulated together with the further addition of sensitizer. In one version of this process the two mixtures are each first provided with an extremely thin, thermally labile pseudo-microcapsule and only then encapsulated together normally with further sensitizer. The microcapsules obtained are then applied to the paper with a binder.

US-A-4 749 679 describes the encapsulation of the dye precursor. For this the dye precursor first has to be dissolved in a suitable solvent and then encapsulated in an aqueous phase. The color developer, optionally a substance to speed up the color-forming reaction, and the aromatic alcohol, carbamate and sulfonamide sensitizers are each dispersed in an aqueous organic phase by milling. The dispersions obtained and the microencapsulated dye-precursor are applied to the paper together.

The disadvantage of these processes is that, first, the choice of sensitizer is limited to substances which do not cause premature development, some of which are costly, and/or, secondly, a large number of operations is required.

DE-A-3 512 565 discloses the encapsulation of waxy substances for preparing spacers for carbonless copy papers.

It is an object of the present invention to provide heat-sensitive recording materials which have good application properties and are inexpensive to prepare.

We have found that this object is achieved by heat-sensitive recording materials comprising one or more optionally polymer enrobed dye precursors, one or more optionally polymer enrobed developers and one or more polymer enrobed sensitizers.

The sensitizers used in the recording materials of the invention are rather hydrophobic, only sparingly water soluble substances which are solid at room temperature, which have a melting point of in general 35°–150° C., preferably 50°–100° C., and which mixed with dye precursors and/or developers lower the melting points thereof.

Suitable sensitizers are for example the waxy substances mentioned for that purpose in US-A-4 520 376, e.g. vegetable waxes which are substantially free of high molecular weight fatty acids, such as candelilla or carnauba wax, hydrocarbon waxes such as paraffins, ozokerite or microcrystalline waves, or else waxy polymers, such as polyethylene or polyvinyl ether waxes or mixtures thereof.

The aromatic, in particular phenolic, sensitizers mentioned in US-A-4 749 679 can likewise be used.

However, particularly preferred sensitizers are monohydric or polyhydric, in general monohydric, dihydric or trihydric, preferably monohydric or dihydric, aliphatic $C_6$–$C_{34}$-alcohols such as hexanediol, octanediol, decanediol, myristyl alcohol, tetradecanediol, eicosanol, myricyl alcohol and in particular cetyl and stearyl alcohol and mixtures thereof.

The particularly preferred alcoholic sensitizers are inexpensive but highly effective substances which have a dissolving (melting) effect on the precursor and/or on the developer even at room temperature.

In the thermal papers of the invention, the sensitizer is used in a polymer enrobed form. For this reason there is no restriction on the choice of suitable compounds, and the advantageous aliphatic alcohols can be used without any problems.

A polymeric robe material for the sensitizer can be made not only of a thermoplastic polymer but also of a thermoset polymer. The enrobed sensitizer melts on heating and thus will destroy even a thermally stable robe.

Suitable are the usual encapsulation polymers mentioned for example in DE-A-3 512 565 such as polyurethanes, polyureas, polyamides, polyesters, polycarbonates or polystyrenes, styrene/acrylate copolymers, styrene/methacrylate copolymers, polyacrylates, polymethacrylates, formaldehyde resins such as urea/formaldehyde, urea/melamine/formaldehyde and melamine/formaldehyde resins and gelatin and also combinations thereof.

Of particular suitability besides polyacrylates and polymethacrylates are urea/melamine/formaldehyde resins, urea/formaldehyde resins and in particular melamine/formaldehyde resins.

The enrobing of the sensitizer according to the invention can be carried out in a conventional manner. It is customary to work at temperatures above the melting point of the sensitizer. If necessary, a pressure vessel has to be used.

Examples of suitable processes are: gelatin coacervation, interface polycondensation to form polyesters or polyamides, interface polyaddition to form polyureas or polyurethanes, free radical interface polymerisation to form polyacrylates or polymethacrylates, the deposition of polymer films by precipitation from polymer solutions, in particular from poly-acrylates or polymethacrylates, and in particular the homo- and co-condensation of urea and/or melamine with formaldehyde.

Particular preference is given to enrobing by polycondensation of melamine with formaldehyde or of precondensates based on melamine/formaldehyde, in particular methylolated and partially etherified, especially methanol-etherified, precondensates.

Enrobing is advantageously carried out in the presence of protective colloids, i.e. water soluble polymers which will stabilize the capsule dispersions being formed.

Suitable are the known% polymers used for this purpose, e.g. polyvinyl alcohol, salts of polyacrylic acid, copolymers of polymerizable di- or higher carboxylic acids with vinyl isobutyl ether, ethylene and/or (meth-)acrylic esters, cellulose derivatives and in particular homo- or copolymers of sulfo-containing monomers.

Examples of the last-mentioned preferred polymers are the homopolymers, known from EP-A-26 914, of sulfoethyl (meth)acrylate, sulfopropyl (meth)acrylate, maleimide-N-ethanesulfonic acid and in particular 2-acrylamido-2-methylpropanesulfonic acid and also the copolymers of these monomers. Particular preference is given to poly(2-acrylamido-2-methylpropanesulfonic acid).

Preference is further given to the copolymers of the abovementioned monomers—likewise mentioned in EP-A-26 914—with $C_1$–$C_3$-alkyl acrylates, hydroxy-$C_2$–$C_4$alkyl acrylates and/or N-vinylpyrrolidone.

Particularly preferred copolymers are the copolymers described in the earlier German Patent Application P 42 09 632.4 of a) from 20 to 90% by weight, preferably from 40 to 75% by weight, of 2-acryla/nido-2-methylpropane-sulfonic acid, sulfoethyl or sulfopropyl (meth)-acrylate or vinylsulfonic acid or salts thereof, b) from 0 to 50% by weight of a vinylic acid, preferably from 20 to 40% by weight of (meth)acrylic acid, c) from 0 to 70% by weight, preferably from 10 to 50% by weight, of methyl or ethyl (meth)acrylate, $C_2$–$C_4$-hydroxyalkyl acrylate or N-vinylpyrrolidone, and d) from 0.1 to 10% by weight, preferably from 0.5 to 5% by weight, of styrene or $C_4$-$C_{18}$-alkyl (meth)-acrylate.

These copolymers are preferably prepared by a conventional free radical polymerization in an aqueous phase.

Viscosities of the polymers of the invention in a 20% strength by weight aqueous solution or dispersion at room temperature and at a shear rate of 489 $s^{-1}$ are in general from 5 to 5000 mPa·s, preferably from 100 to 2000 mPa·s, particularly preferably from 250 to 1500 mPa·s.

With melamine/formaldehyde resin the sensitizer is for example in general enrobed by heating the sensitizer in an aqueous phase to above its melting point and dispersing it finely to a particle size of from 1 to 100 μm using a high performance disperser in the presence of one of the protective colloids mentioned. The aqueous solution of melamine/formaldehyde precondensate is then added over 1 to 240 min at a temperature of in general 35° to 150 ° C., preferably 35° to 90 ° C., and at a pH of usually 3.0 to 7.0, in particular 3.5 to 5.5, set with an inorganic or organic acid (e.g. sulfuric acid, hydrochloric acid, phosphoric acid, formic acid, acetic acid). After further heating at 35° to 100 ° C., for 0.5 to 5 h, the dispersion is cooled down and neutralized with an inorganic or organic base (sodium hydroxide, potassium hydroxide, calcium hydroxide, ammonia, alcohol a/nines such as di- and triethanolamine).

The resulting dispersion of polymer-enrobed sensitizer can advantageously be used directly in a coating composition for thermal papers.

The particle size of the polymer-enrobed sensitizer is predominantly, i.e. to an extent of about 70 to 100%, below 20 μm, preferably below 10 μm.

Suitable dye precursors for the recording materials of the invention are in particular those which will form their dyes on contact with an electron acceptor by donation of an electron or acceptance of a proton.

Preferred dye precursors are for example the lactones such as, in particular, crystal violet lactone and the rhodamine- and diaza-rhodamine lactones, the phthalides, the spirodipyrans such as, in particular, the spirodibenzopyrans and in particular the fluorans.

Since there are many applications, inter alia the fax process, for which precursors to black dyes are desirable, particular preference is given for example to 2-N-phenylamino-3-methyl-6-dialkyl- or -diaryl-aminofluorans.

Of these, 2-N-phenylamino-3-methyl-6-diethylaminofluoran (diethylaminofluoran for short)

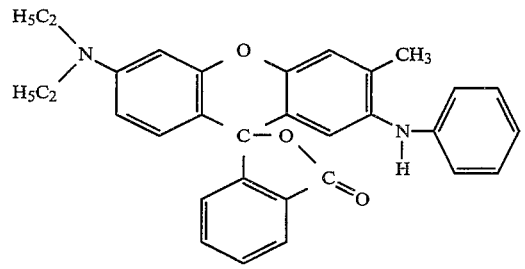

is very particularly notable on account of its high reactivity.

It is of course also possible to use dye precursor mixtures, which may contain dye precursors from one or more of the classes of compounds mentioned, in order to obtain a desired color, for example black.

In general, dye precursors which are less reactive and which are not prematurely developed in the course of the extremely fine grinding in aqueous medium required for the preparation of the dispersion do not need to be provided with a protective robe in the thermal papers of the invention. If, moreover, water-insoluble developers are used, the protection afforded by the enrobing of the sensitizer is in general sufficient to prevent even discoloration in the course of the mixed dye precursor, developer and sensitizer dispersions being applied to the base paper.

If, however, it is desired, not least for cost reasons, to use dye precursors and developers which do not meet the abovementioned criteria, it is advisable to provide the dye precursor by the method described in DE-A-4

103 966 with a first robe of a water-soluble, nonionic polymer, in particular polyvinylpyrrolidone (K values according to H. Fikentscher, Cellulosechemie 13 (1932), 48–64, 71–74, in general of 10 to 100, preferably to 90, in 1% by weight strength by weight aqueous solution at 25° C.), by grinding in aqueous dispersion and then to enclose it by polycondensation with a second robe of a crosslinked polymer, in particular a melamine/formaldehyde resin. For this the directions given in DE-A-4 103 966 can be followed.

Suitable developers for the thermal papers of the invention are the usual electron acceptors used for this purpose. There are for example those based on silicates such as activated and acidic clay, attapulgite, bentonite, colloidal silicon dioxide and aluminum, magnesium and zinc silicates, carboxylic acids such as oxalic, maleic, succinic, tartaric, citric or stearic acid, benzoic or p-tertbutyl benzoic acid, phthalic acid, gallic acid and salicylic or substituted salicylic acid such as 3-isopropyl-, 3-cyclohexyl-, 3,5-di-tert-butyl- or 3,5-di(2-methylbenzyl)-salicylic acid, phenol derivatives such as 4,4'-isopropylidenediphenol, -bis(2-chlorophenol), -bis(2,6-dichloro-phenol),-bis (2,6-dibromophenol),-bis(2,6-dimethylphenol) or -bis(2-tert-butyl phenol), 2,2'-methylene-bis (4-chlorophenol) or -bis(4-methyl-6-butylphenol), 4,4'-sec-butylidenediphenol, 4,4'-cyclohexylidene-diphenol or -bis(2-methylphenol), 2,2'-dihydroxybiphenyl, 4-tert-butyl- or 4-phenyl-phenol, phenolic resins, $\alpha$- or $\beta$-naphthol, methyl 4-hydroxybenzoate, and salts of these organic acceptors.

Developers based on phenol are preferred for the recording materials of the invention. 4,4'-Isopropylidenediphenol (bisphenol A) is particularly preferred.

It is possible for the surface of the developer to be coated with a polymer. In general, however, this is not necessary, even in the case of at least partially water soluble compounds, if the dye precursor is surrounded by a polymer robe.

The heat sensitive recording materials of the invention can be prepared in a conventional manner. For this a usually about 20 to 70% strength by weight aqueous dispersion of the (optionally coated) dye precursor, and about 20 to 70% strength by weight aqueous dispersion of the (optionally coated) developer and an about 20 to 70% strength by weight aqueous dispersion of the polymer enrobed sensitizer are either first mixed in a weight ratio of about 1:4:4 to 1:15:15 or directly added in that weight ratio to an aqueous solution or dispersion of a binder. Suitable binders are for example solutions of polyvinyl alcohol and/or binder dispersions based on styrene/acrylate or styrene/butadiene which may additionally contain a pigment or a filler such as calcium carbonate, titanium dioxide, kaolin, a synthetic silicate or a hydrated aluminum oxide. The thermal dispersions obtained are applied to the base material, usually paper, the surface of which has in general been glazed, in a layer thickness of about 4 to 7 g/m$^2$. The paper thus coated is then dried.

The heat-sensitive recording materials of the invention are free of any visible background staining. The prints have an intensity of black or, more generally, color which is superior to that obtained with thermal papers prepared as described in DE-A-4 103 966 without polymer-enrobed sensitizers. The choice of dye precursor, developer and sensitizer is not as in US-A-4 520 376 and 4 749 679 restricted to certain substances, making it possible, in particular, to obtain inexpensive thermal papers having advantageous application properties.

EXAMPLES a) Preparation of polymer-enrobed sensitizer

EXAMPLES 1 to 6

In a 4 l stirred cylindrical vessel with an in-built high performance dispersing unit (laboratory mixer from Pendraulik, model LD 50, equipped with a slant toothed disk), a mixture of 600 g of water, 520 g of the sensitizer X and 106 g of a 20% strength by weight aqueous solution of the protective colloid A: a copolymer formed from 236 g 2-acrylamido-2-methylpropanesulfonic acid, neutralized with 305 g of 20% strength by weight sodium hydroxide solution, 80 g of methyl acrylate and 4 g of styrene in an aqueous phase at 85° C. using 0.5 g of potassium peroxodisulphate as initiator (viscosity in 20% strength by weight aqueous solution at room temperature and at a shear rate of 489 s$^{-1}$: 1100 mPa·s), or B: poly-2-acrylamido-2-methylpropanesulfonic acid (K value 140)

was heated at 3000 rpm to 60° C. and adjusted with 10% strength by weight formic acid to pH 4.5.

Then y g of a 70% strength by weight aqueous solution of a methylolated, partially etherified melamine/formaldehyde (M/F) precondensate (see Example 1 of DE-A-3 512 565) were added at 6000 rpm and T° C. over 52 min while the pH was maintained at 4.5 with an acid.

Then the dispersion was transferred to a propeller-stirred vessel and heated therein at 80° C. for 2 h with a low degree of shear. After cooling down to room temperature, the dispersion was neutralized with triethanolamine.

In each case a milky white dispersion was obtained which was filterable through a 40 $\mu$m filter with virtually no residue.

The particle sizes of the polymer-enrobed sensitizers determined by microscope and further details concerning these experiments are summarized in Table 1.

TABLE 1

| Example | Sensitizer X | y g of M/F precondensate solution | Protective colloid | T [°C.] | Particle size of polymer-enrobed sensitizer [$\mu$m] |
|---|---|---|---|---|---|
| 1 | cetyl alcohol | 115 | A | 60 | 1–7, max. 12 |
| 2 | cetyl alcohol | 86 | A | 60 | 1–7, max. 12 |
| 3 | cetyl alcohol | 58 | A | 60 | 1–7, max. 12 |
| 4 | cetyl alcohol/ stearyl alcohol (w/w 1:1) | 115 | A | 70 | 1–8, max. 12 |
| 5 | stearyl alcohol | 86 | B | 65 | 1–8, max. 10 |

TABLE 1-continued

| Example | Sensitizer X | y g of M/F pre-condensate solution | Protective colloid | T [°C.] | Particle size of polymer-enrobed sensitizer [μm] |
|---|---|---|---|---|---|
| 6 | cetyl alcohol | 86 | B | 60 | 1–10 |

b) Preparation of enrobed dye precursor 10 g of the dye precursor 2-N-phenylamino-3-methyl-6-diethylaminofluoran was bead milled with 15 g of water and 1.5 g of a 10% strength by weight aqueous dispersion of polyvinylpyrrolidone (K 30) to an average particle size of 1 μm.

Thereafter the dye precursor dispersion thus pretreated was admixed, by stirring, first with 1.9 g of a mixture of a 70% strength by weight aqueous solution of melamine-formaldehyde resin (molar ratio melamine: formaldehyde = from 1:5.6 to 1:6.2) and a 20% strength by weight aqueous solution of poly-2-acrylamido-2-methylenepropanesulfonic acid (K value 140) in a weight ratio of 1:1 and then with 0.22 g of sodium dihydrogen phosphate. The pH was then adjusted to 4.2 with formic acid. After stirring at room temperature for one hour with the addition of 2.5 g of water, the mixture was stirred at 70° C. for a further 2 h until fully cured.

The about 35% strength by weight aqueous dispersion of 2-N-phenylamino-3-methyl-6-diethylaminofluoran obtained was free of any visible coloration. Photometric measurement revealed an intensity value of 0.1 K/S-100.

c) Preparation of thermal papers according to the invention 5 g of a 40% strength by weight aqueous dispersion of the polymer-enrobed sensitizer obtained under a) (Example 2*a*: 7.5 g), 1.5 g of a 30% strength by weight aqueous dispersion of the dye precursor obtained under b) and 4 g of a 50% strength by weight aqueous dispersion of bisphenol A as developer were added to 3 g of a 5% strength by weight clear aqueous solution of polyvinyl alcohol (Rhodoviol® 4/20, Rhone Poulenc) containing 30% by weight of dispersed calcium carbonate.

The thermal dispersions obtained remained stable, i.e. did not develop any graying, for a prolonged period.

A thermal dispersion prepared for comparison with unencapsulated sensitizer rapidly developed a gray color and, what is more, was very difficult to divide finely.

The thermal dispersions were then applied in a thickness of 7 g/cm$^2$ to base paper using a KCC 202 coater from Gockel (Munich).

After drying with hot air at not more than 50° C., the thermal paper was glazed using a glazing press fitted with a high gloss metal plate by pressing the thermal paper with its coated side against the metal plate at room temperature and 100 bar for 1 min.

Development of these heat-sensitive layers was in each case carried out using an Electronic Systems thermal printer from Neckarsteinach GmbH and thermal pulses of 1, 2, 3 and 4 ms duration.

The intensity of the blacks obtained was measured with a Datacolor 200 photometer from Leitz in K/S·100 using the Kubelka-Munk relation (Kunststoff-Rundschau 17 (1970), 282–291). The reflectance of the uncoated paper was taken as standard.

The results of these measurements are listed in Table 2.

C denotes, as a comparison for the thermal papers prepared according to the invention with polymer-enrobed sensitizer (Examples 1 to 4), a thermal paper prepared in a similar fashion but without the sensitizer and which produced distinctly worse intensity values.

TABLE 2

| Example | Color intensity in K/S · 100 on development under a thermal pulse of | | | |
|---|---|---|---|---|
| | 1 ms | 2 ms | 3 ms | 4 ms |
| 1 | 1.0 | 4.7 | 14.8 | 22.2 |
| 2 | 1.1 | 5.6 | 13.9 | 21.8 |
| 2a | 1.5 | 7.3 | 16.5 | 22.5 |
| 3 | 0.9 | 6.2 | 15.2 | 24.1 |
| 4 | 0.7 | 4.6 | 13.4 | 20.4 |
| 5 | 1.5 | 7.8 | 15.6 | 23.1 |
| 6 | 2.9 | 11.6 | 21.7 | 29.3 |
| C | 0.3 | 2.4 | 10.1 | 18.0 |

We claim:

1. Heat-sensitive recording materials comprising one or more optionally polymer encapsulated dye precursors, one or more optionally polymer encapsulated developers and one or more polymer encapsulated sensitizers, wherein said one or more sensitizers are encapsulated separately from said one or more dye precursors and said one or more developers and wherein said sensitizers are monohydric or polyhydric aliphatic $C_6$–$C_{34}$-alcohols or mixtures thereof.

2. Heat-sensitive recording materials as claimed in claim 1, wherein the polymer around the sensitizer consists essentially of a urea/formaldehyde resin, a urea/melamine/formaldehyde resin, a melamine/formaldehyde resin, a polyurethane, a polyurea, a polyamide, a polyester, a polycarbonate, a polystyrene, a styrene/acrylate copolymer, a styrene/methacrylate copolymer, a polyacrylate, a polymethacrylate, gelatin or combinations thereof.

3. Heat-sensitive recording materials as claimed in claim 1, wherein the polymer around the sensitizer consists essentially of a melamine/formaldehyde resin,a urea/melamine-formaldehyde resin, a urea/formaldehyde resin, a polyacrylate or a polymethacrylate.

4. Heat-sensitive recording materials as claimed in claim 1, wherein the polymer around the sensitizer was formed in the presence of 2-acrylamidopropanesulfonic acid homopolymers or copolymers as protective colloids.

5. Heat-sensitive recording materials as claimed in claim 1, wherein the dye precursor has been provided with a first microcapsule comprising a water-soluble, nonionic polymer and a second microcapsule comprising a crosslinked polymer.

6. Heat-sensitive recording materials as claimed in claim 1, wherein the developer has been provided with a first microcapsule comprising a water-soluble, nonionic polymer and a second microcapsule comprising a crosslinked polymer.

* * * * *